United States Patent [19]

Korzenowski

[11] Patent Number: 5,069,457

[45] Date of Patent: Dec. 3, 1991

[54] ELBOW SUPPORT

[76] Inventor: Walter Korzenowski, Box 238, Norman Wells, Northwest Territories, Canada, X0E 0V0

[21] Appl. No.: 171,761

[22] Filed: Mar. 22, 1988

[51] Int. Cl.[5] ..... A63B 69/36

[52] U.S. Cl. ..... 273/189 R; 273/DIG. 30; 128/DIG. 15; 128/77; 128/881; 2/DIG. 6

[58] Field of Search ..... 273/188 R, 189 R, 189 A, 273/29 A, DIG. 30, 54 B; 128/80 R, 80 C, 80 H, 80 J, 77, DIG. 15, 637, 677, 157, 165, 87 R, 878, 881, 877; 24/442, 306; 2/DIG. 6, 16

[56] References Cited

U.S. PATENT DOCUMENTS

| | | | |
|---|---|---|---|
| 238,449 | 3/1924 | Graves . | |
| 2,468,580 | 4/1949 | Weis et al. . | |
| 3,106,718 | 10/1963 | Raab | 273/189 A |
| 3,633,567 | 1/1972 | Sarnoff | 128/DIG. 15 |
| 4,476,857 | 10/1984 | Levine | 128/77 |

FOREIGN PATENT DOCUMENTS

| | | | |
|---|---|---|---|
| 695379 | 9/1964 | Canada . | |
| 1049580 | 2/1979 | Canada . | |
| 1111201 | 10/1981 | Canada . | |
| 1263391 | 4/1960 | France | 2/DIG. 6 |

*Primary Examiner*—Edward M. Coven
*Assistant Examiner*—Sebastiano Passaniti
*Attorney, Agent, or Firm*—Davis, Bujold & Streck

[57] ABSTRACT

There is disclosed a golf instruction aid which is readily adjustable to permit the stiffening support of the leading arm to be released between strokes for the greater convenience and comfort of the golfer. The device is comprised of a flexible sleeve; a tensioning strip attached to and depending from the sleeve, the width of the strip being substantially the same as the length of the sleeve, the strip having a first side, a second side and an end remote from the sleeve; a first fastener disposed on the first side of the strip at the remote end; and a second fastener disposed at a point on the second side of the strip, whereby the strip may be wrapped around the sleeve and maintained in tension by securing the first fastener to the second fastener.

4 Claims, 5 Drawing Sheets

ELBOW SUPPORT

The present invention relates to a golf instruction aid.

BACKGROUND OF THE INVENTION

It is recognized in the art of golf instruction that a golfer should maintain a substantially stiff leading arm during the major portions of his back swing and follow through. This technique is attributed as being the key to distance and accuracy of direction.

Golf instruction devices have been developed to assist golfers improve this aspect of their technique, such as U.S. Pat. No. 2,468,580. These devices have not come into popular usage, however, as the support they provide to stiffen the leading arm cannot be readily released between strokes.

SUMMARY OF THE INVENTION

The primary object of the present invention is to provide a golf instruction apparatus which is readily adjustable to permit the stiffening support of the leading arm to be released between strokes for the greater convenience and comfort to the golfer.

Broadly, the present invention provides an instructional aid for use by golfers which is comprised of a flexible sleeve; a tensioning strip attached to and depending from the sleeve, the width of the strip being substantially the same as the length of the sleeve, the strip having a first side, a second side and an end remote from the sleeve; a first fastening means disposed on the first side of the strip at the remote end; and a second fastening means disposed at a point on the second side of the strip, whereby the strip may be wrapped around the sleeve and maintained in tension by securing the first fastening means to the second fastening means.

BRIEF DESCRIPTION OF THE DRAWINGS

These and other features of the invention will become more apparent from the following description in which reference is made to the appended drawings, wherein.

DETAILED DESCRIPTION OF THE INVENTION

Figure 1:
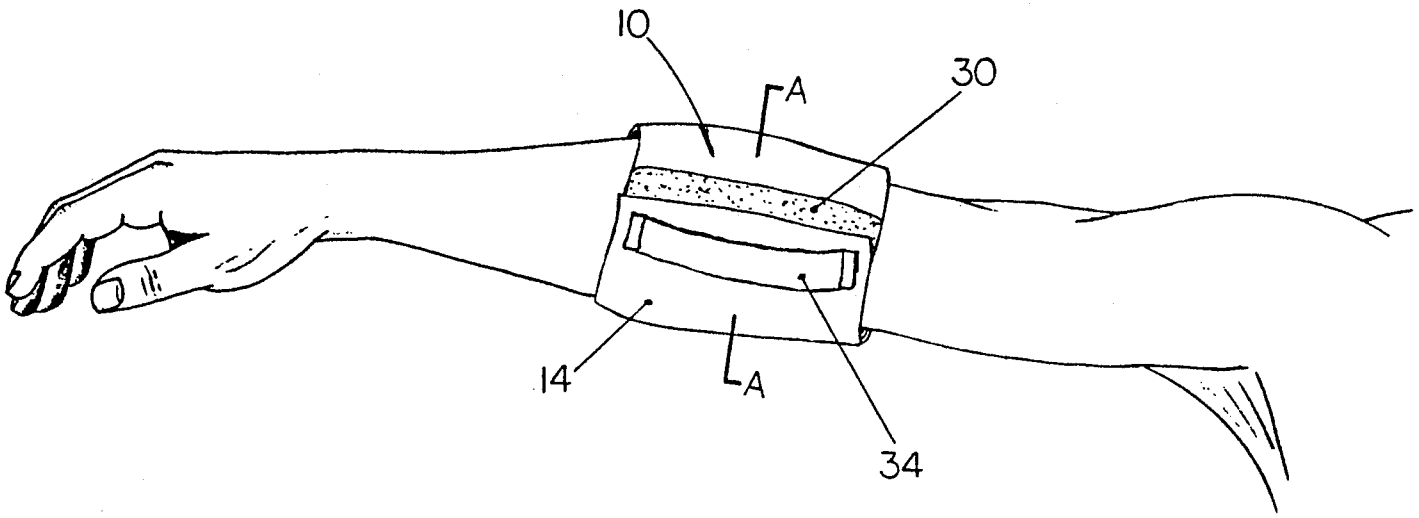
FIG. 1 is perspective view of a preferred embodiment of the invention.

The invention which is hereinafter described relates to an instructional aid for use by golfers, generally indicated by reference numeral 10, and illustrated in FIGS. 1 through 6.

Figures 2, 3:
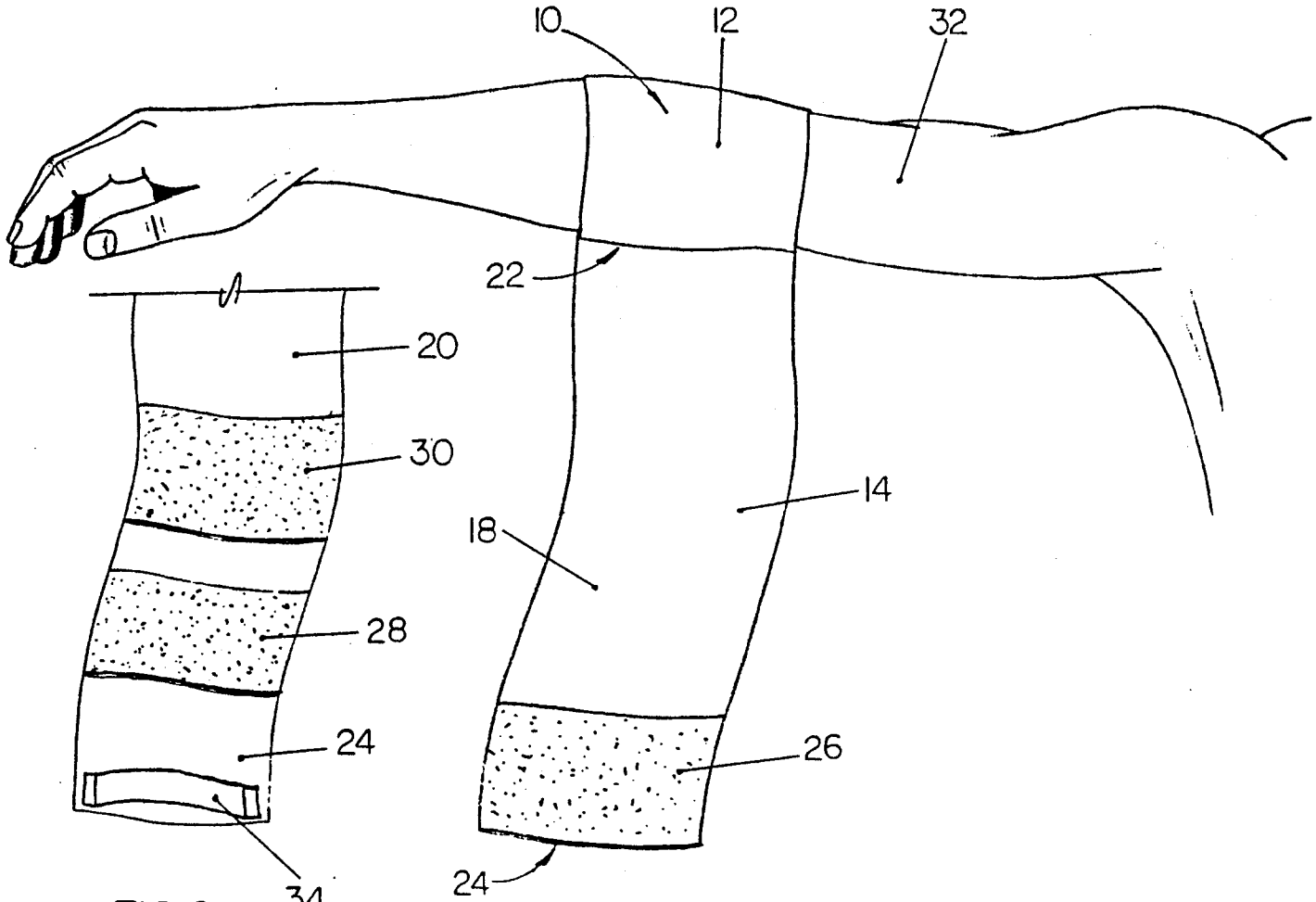
FIG. 2 is a rear view of a portion of a preferred embodiment of the invention.
FIG. 3 is a front view of a preferred embodiment of the invention.
Figure 4:
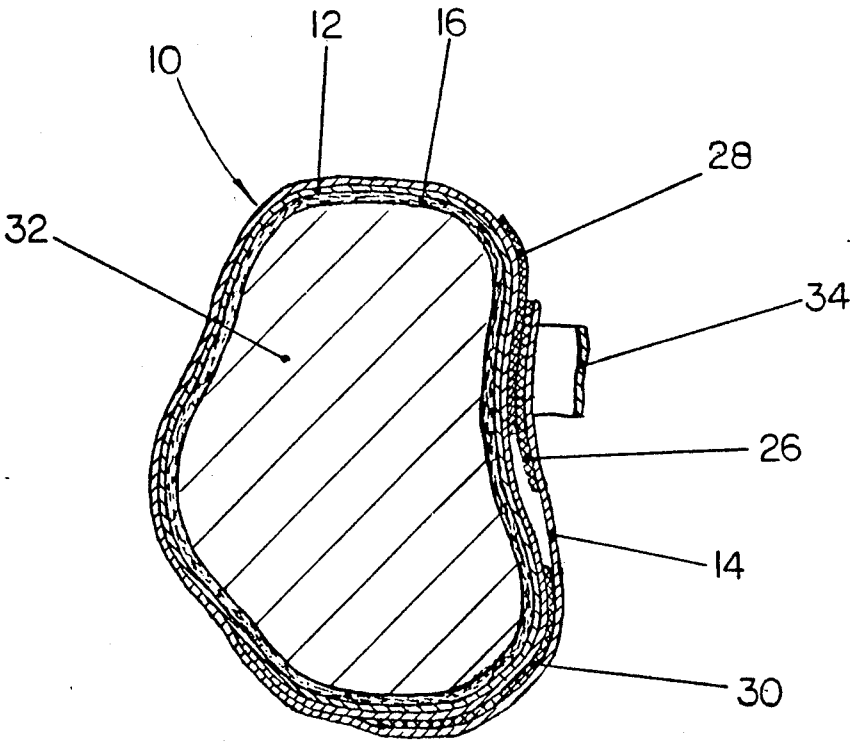
FIG. 4 is a section view of a preferred embodiment of the invention taken along section lines A—A of FIG. 1.

Instructional aid 10 is comprised of two primary components, as illustrated in FIGS. 2 and 3, namely; a flexible sleeve 12 and an elastic tensioning strip 14. Flexible sleeve 12 is made of elastic material in order that it will be expandable. With reference to FIG. 4, flexible sleeve 12 has a moisture absorbent lining 16, the purpose of which will be hereinafter described. Tensioning strip 14 is attached longitudinally to and depends from sleeve 12. The width of tensioning strip 14 is substantially the same as the length of sleeve 12. Tensioning strip 14 has two sides 18 and 20, and two ends 22 and 24. End 22 is attached to sleeve 12, and end 24 is remote from sleeve 12. Velcro fasteners 26 and mating fasteners 28 and 30 are attached to tensioning strip 14. Velcro fastener 26 consists of a 4 to 6 inch band which is attached to side 18 of tensioning strip 14 at remote end 24. Velcro fasteners 28 and 30 are attached at intervals to side 20 of tensioning strip 14. To facilitate the tensioning of instructional aid 10, there is provided a handle 34.

Figure 5:
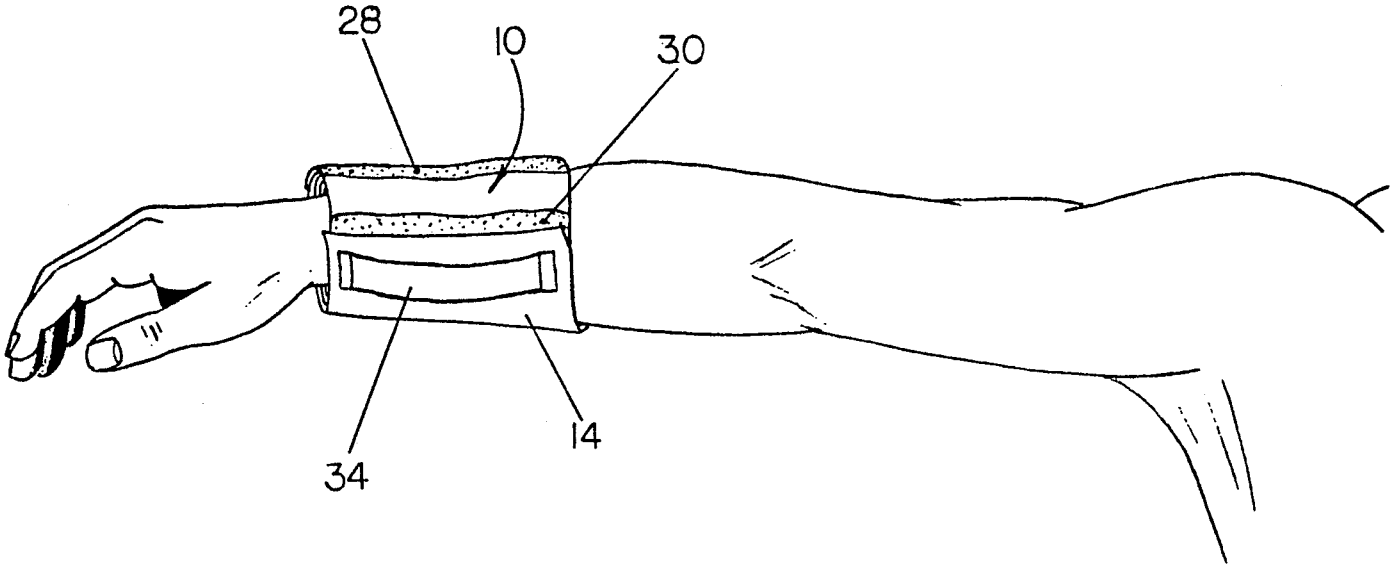
FIG. 5 is an alternate perspective view of a preferred embodiment of the invention.
Figure 6:
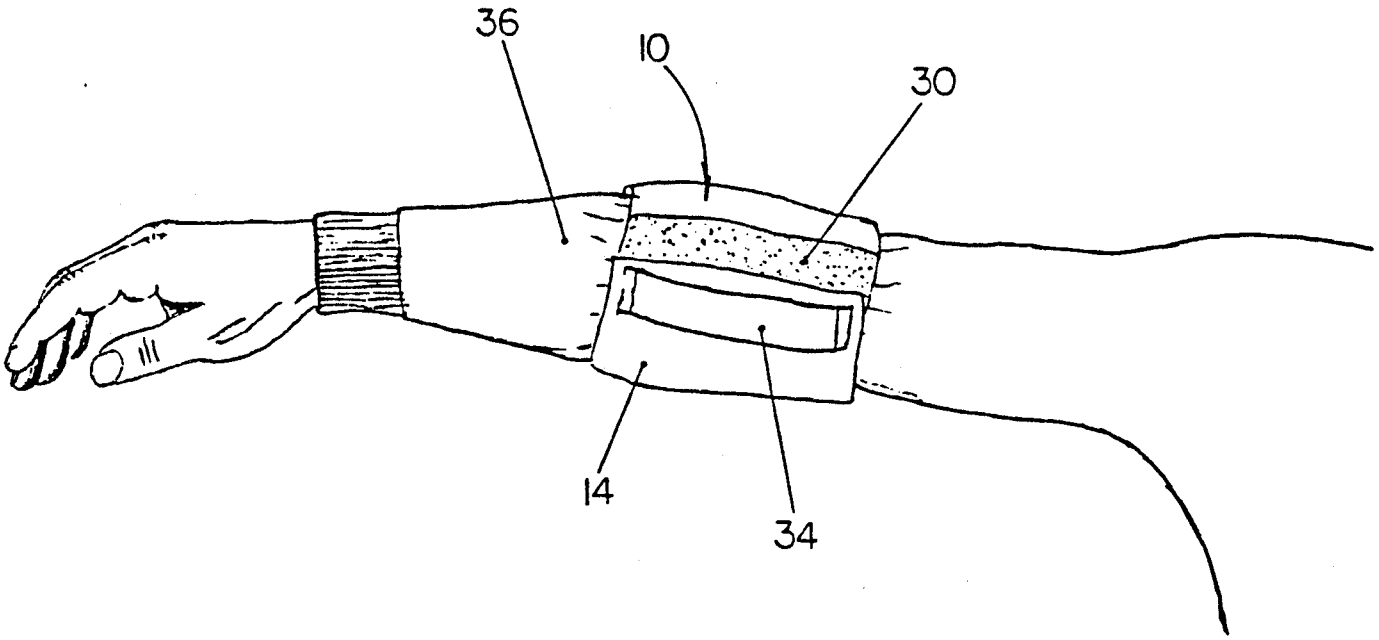
FIG. 6 is a perspective view of an alternate preferred embodiment of the invention.

In order to use instructional aid 10, the golfer must pull sleeve 12 onto his arm 32 covering his elbow joint, as illustrated in FIG. 3. Tensioning strip 14 is then loosely wrapped around sleeve 12 and fastened in place by securing fastener 26 to mating fastener 30. When the golfer desires the assistance of instructional aid 10, he grasps handle 34 and places tensioning strip 14 in tension by securing fastener 26 to fastener 28. This "ready" position is illustrated in FIG. 1. Tensioning strip 14 then maintains leading arm 32 of the golfer in a stiffened position while the golfer makes his shot. Once the golfer has finished making his shot, he releases fastener 28 from engagement with fastener 26 to relieve the tension on his arm 32 and attaches fastener 26 to fastener 30. When fastener 26 is secured to fastener 30 tensioning strip 14 is no longer in tension, and instructional aid 10 lightly engages arm 32. Sleeve 12 is lined with a terry cloth moisture absorbing lining 16 in order to serve as a sweat band when tensioning strip 14 is not in tension. On warm days, it is anticipated that a golfer will move sleeve 12 down his arm to the wrist and forearm area between shots in the fashion of the popular sweat bands, as illustrated in FIG. 5. Instructional aid 10 can be adapted for use in cooler weather, by incorporating the invention into a jacket or windbreaker as illustrated in FIG. 6. When incorporating instructional aid 10 in this fashion the material of jacket 36 takes the place of lining 16. If jacket 36 is cut in such a fashion as to be tight on the golfers arm 32, sleeve 12 may also be replaced with tensioning strip 14 depending directly from jacket 36.

It will be apparent to one skilled in the art that the ability to relieve the tensioning on sleeve 12, will permit the golfer the comfort of a sweat band, and yet the ability to have assistance in stiffening his leading arm while playing shots as desired. This is particularly advantageous where the golfer only desires to use the golf aid while driving off the tee.

The embodiments of the invention in which an exclusive property or privilege is claimed are defined as follows:

1. An instructional aid for use by golfers comprising:

a. an elastic sleeve adapted to surround the elbow region of a golfer;

b. a tensioning strip attached to and depending from said sleeve, the width of said tensioning strip being substantially the same as the longitudinal length of said sleeve, said strip having a first side, a second side and an end remote from said sleeve, said remote end having handle means on said second side;

c. first fastening means disposed on said first side of said strip at said remote end; and d. second fastening means disposed at regularly spaced points along said second side of said strip whereby said strip may be wrapped around said sleeve, by pulling on said handle means, and maintained in one of at least first and second positions by securing said first fastening means to one of said second fastening means such that in said first position stiffening support is provided to said elbow region and in said second position said elbow region is free to bend.

2. The instructional aid as defined in claim 1, wherein said sleeve has a moisture absorbent lining.

3. The instructional aid as defined in claim 1, said tensioning strip being of an elastic material.

4. The instructional aid as defined in claim 1, said first and second fastening means being Velcro fasteners.

* * * * *